US005553543A

United States Patent [19]

Takahashi et al.

[11] Patent Number: 5,553,543

[45] Date of Patent: Sep. 10, 1996

[54] PRINT SHEET LEADING END MOUNTING DEVICE HAVING MEANS FOR LIFTING RELEASED LEADING END

[75] Inventors: Yasuhiro Takahashi; Koji Nakayama, both of Tokyo, Japan

[73] Assignee: Riso Kagaku Corporation, Tokyo, Japan

[21] Appl. No.: 578,488

[22] Filed: Dec. 26, 1995

[30] Foreign Application Priority Data

Dec. 28, 1994 [JP] Japan ..... 6-339108

[51] Int. Cl.[6] ..... B41F 1/30

[52] U.S. Cl. ..... 101/409; 101/415.1; 101/477; 271/82

[58] Field of Search ..... 101/408, 409, 101/410, 415.1, 477, 378, 382.1, DIG. 36; 271/82

[56] References Cited

U.S. PATENT DOCUMENTS

| | | | |
|---|---|---|---|
| 3,702,098 | 11/1972 | Eburn, Jr. et al. | 101/415.1 |
| 5,322,014 | 6/1994 | Keller | 101/415.1 |
| 5,359,933 | 11/1994 | Blaser | 101/409 |
| 5,402,727 | 4/1995 | Matsuo et al. | 101/477 |
| 5,479,859 | 1/1996 | Lindner et al. | 101/DIG. 36 |

FOREIGN PATENT DOCUMENTS

| | | |
|---|---|---|
| 4-361043 | 12/1992 | Japan . |
| 5-330244 | 12/1993 | Japan . |
| 7-137419 | 5/1995 | Japan . |
| 7-179014 | 7/1995 | Japan . |

*Primary Examiner*—Eugene H. Eickholt
*Attorney, Agent, or Firm*—Oliff & Berridge

[57] ABSTRACT

In order to ensure that the leading end of a print sheet mounted to the back press means by a clamp member is engaged by a claw member for removing the print sheet from the back press means when the leading end has been released from the clamping by the clamp member, there is provided a means for lifting up the leading end of the print sheet above a supporting surface therefor of the back press means after the release of the leading end from the clamp member.

5 Claims, 5 Drawing Sheets

PRINT SHEET LEADING END MOUNTING DEVICE HAVING MEANS FOR LIFTING RELEASED LEADING END

BACKGROUND OF THE INVENTION

1. Field of the Invention

The present invention relates to the field of rotary stencil printer, and more particularly, to a device for mounting a leading end of a print sheet of a rotary stencil printer having a printing drum for carrying a stencil sheet therearound and a back press means having a surface for supporting the print sheet such that the print sheet is transferred through between the printing drum and the back press means with the leading end thereof being mounted to the back press means by the print sheet leading end mounting device so as to be applied with a stencil printing thereon.

2. Description of the Prior Art

As a countermeasure for avoiding the back contamination of printed sheets which occurs when the printed sheets produced by the stencil printing are immediately laid one over the other, it has been proposed by Japanese Patent Application 4-163590 (Laid-open Publication 5-330244) filed on 29 May 1992 by the same applicant as the present application by claiming a domestic priority based upon Japanese Patent Application 3-162218 filed on 6 Jun. 1991, to decrease the thickness of an ink layer provided on the surface of a print sheet by the stencil printing to be the necessary minimum required for providing a clear indication of a printed image, by supplying ink to a perforated stencil sheet on one surface thereof in the form of an ink layer, with the other surface of the stencil sheet having been pressed against a surface for printing, then applying a pressure to the ink layer by a pressing means such that the ink of the ink layer is transferred from said one surface to said other surface of the stencil sheet through perforations of the stencil sheet to be attached on the surface for printing, and then to remove the surface for printing from said other surface of the stencil sheet at a portion where any substantial flow of the ink of the ink layer relative to the stencil sheet is held by the pressing means which has applied the pressing force to the ink layer under the condition that said other surface of the stencil sheet is in a tight contact with the surface for printing, and further to provide, in carrying out the stencil printing according to the above-mentioned principle by a rotary stencil printer, a device for selectively mounting the leading end of a print sheet to a back press means which supports the print sheet against a printing drum carrying a stencil sheet such that the print sheet provided with an ink image thereon by the pressing contact with the printing drum carrying the stencil sheet under the support of the back press means is, after the application of the stencil printing, forcibly removed from the printing drum as firmly held on the back press means, wherein said device for selectively mounting the leading end of a print sheet to the back press means is a claw-like clamp member adapted to selectively clamp the leading end of a print sheet to the print sheet supporting surface of the back press means.

When the print sheet leading end mounting device of the above-mentioned construction operates to conduct the leading end of a print sheet through a nip region where the printing drum and the back press means are pressed against one another, if the clamp member is protrudent above the print sheet supporting surface of the back press means, smooth operation of the rotary stencil printer is obstructed.

Therefore, it is desired that, when such a print sheet leading end mounting device is in the operating condition, the claw-like clamp member is sunk below the contour of the print sheet supporting surface of the back press means. However, the condition that the claw-like clamp member is sunk below the contour of the print sheet supporting surface of the back press member implies that the leading end of a print sheet clamped by the clamp member is bent into the inside of the back press means relative to a principal portion of the print sheet following the leading end as supported on the print sheet supporting surface of the back press means.

When the leading end of a print sheet mounted to the back press means by the claw-like clamp member has been bent against the following principal portion thereof so as to sink below the contour of the print sheet supporting surface of the back press means, it occurs that, when the printing process proceeds so far that the clamping of the leading end by the clamp member is released for the print sheet to be removed from the back press means, starting from the leading end, by a print sheet removal claw member being engaged under the leading end of the print sheet, the leading end of the print sheet bent below the contour of the print sheet supporting surface of the back press means is not engaged by the tip of the print sheet removal claw member, endangering a regular transfer of the print sheet toward a print sheet disposal means.

SUMMARY OF THE INVENTION

In view of the above-mentioned problem in the prior art, it is an object of the present invention to provide an improved print sheet leading end mounting device which ensures a regular transfer of a print sheet toward a print sheet disposal means when the print sheet is removed from the back press means, such that the leading end of the print sheet released from the clamping by the clamp member is definitely caught by the print sheet removal claw, even when the leading end of the print sheet is sunk below the contour of the print sheet supporting surface of the back press means in the clamped condition and got bent relative to the following principal portion thereof.

According to the present invention, the above-mentioned object is accomplished by a device for mounting a leading end of a print sheet of a rotary stencil printer having a printing drum for carrying a stencil sheet therearound and a back press means having a surface opposing said printing drum for supporting the print sheet such that the print sheet is transferred through between said printing drum and said back press means with the leading end thereof being mounted to said back press means by said print sheet leading end mounting device so as to be applied with a stencil printing thereon, comprising a combination of a claw-like clamp member for selectively clamping the leading end of the print sheet to said back press means and a print sheet leading end lifting means for pushing the leading end of the print sheet to be floated up from the print sheet supporting surface of said back press means.

By the print sheet leading end mounting device being constructed as a combination of a claw-like clamp member for selectively clamping the leading end of a print sheet to said back press means and a print sheet leading end lifting means for pushing the leading end of the print sheet to be floated up from the print sheet supporting surface of said back press means, when the clamping of the leading end of the print sheet by said clamp member is released, the leading end of the print sheet is brought to a condition floating up from the print sheet supporting surface of the back press means by the print sheet leading end lifting means even if the bent shape of the leading end of the print sheet is not restored to the original straight shape, such that the leading end of the print sheet is definitely engaged by a print sheet removal claw, whereby the print sheet is definitely transferred along a regular transfer route toward the print sheet disposal means, starting from the leading end, as guided by the print sheet removal claw.

The clamp member may be a pivoting member adapted to selectively pivot about a pivot axis disposed adjacent the print sheet supporting surface of said back press means to selectively clamp the leading end of a print sheet, and said print sheet leading end lifting means may be integrally connected with said clamp member so as to pivot about said pivot axis together with said clamp member such that, when said clamp member turns to clamp the leading end of the print sheet from an upper surface thereof to said back press means, said print sheet leading end lifting means moves to depart from a lower surface of the leading end of the print sheet, while, when said clamp member turns to release the leading end of the print sheet, said print sheet leading end lifting means turns to push up the leading end of the print sheet from the lower surface thereof. By such an arrangement, the print sheet leading end lifting means can be moved between operating and non-operating positions thereof by directly utilizing the pivoting movement of the clamp member about the pivot axis for clamping and releasing the leading end of a print sheet, so that the construction and the operation of the print sheet leading end lifting means are simplified.

Alternatively, the print sheet leading end lifting means may be a ventilation means for blowing air to the print sheet leading end from the lower surface thereof. By such an arrangement, the print sheet leading end lifting means is available by providing an appropriate air passage in the back press means, without requiring any mechanically movable o member, so that the construction and the operation of the print sheet leading end lifting means are also simplified.

In this case, the ventilation means may particularly be adapted to make ventilation by a flow of air generated relative to said back press means when said back press means moves to transfer the print sheet during the stencil printing. By such an arrangement, the ventilation means is obtained without any such particular means as fan, air pump, etc.

The print sheet leading end mounting device according to the present invention is particularly effective when the back press means is a roller adapted to rotate in synchronization with rotation of a printing drum and having a groove for receiving a stencil sheet leading end mounting means of the printing drum at a portion thereof which aligns with the stencil sheet leading end mounting means during the synchronized rotation, wherein the back press roller is so adapted as to apply a squeezing action to a circumferential portion of the printing drum where an ink leakage can occur beyond a leading edge of a perforated circumferential wall portion of the printing drum, so as thereby to prevent an ink leakage, as proposed by Japanese Patent Application 6-66708 filed on 10 Mar. 1994 under the claiming of a domestic priority of Japanese Paten Application 5-306038 filed on 12 Nov. 1993 by the same applicant as the present invention, and further the position of the print sheet leading end mounting device in the back press roller is so determined as to be leave a substantial circumferential band area along an adjacent edge of the groove so that said squeezing action is not lost even when the relative rotational angle between the printing drum and the back press roller is varied within a predetermined adjustment range as proposed by Japanese Patent Application 5-306033 filed on 12 Nov. 1993 by the same applicant as the present application. The reason for this is that, when the position of the print sheet leading end mounting device is so shifted from the adjacent edge of the groove along the circumference of the back press roller to be substantially apart therefrom, the leading end of the print sheet, when released from the clamping by the clamp member, is no longer applied with an air turbulence generated by the edge of the groove during the rotation of the back press roller, which would be effective, if available, to lift up the leading end of the print sheet released from the clamp member.

BRIEF DESCRIPTION OF THE DRAWING

In the accompanying drawing.

FIG. I is a diagrammatic view showing the overall construction of an example of rotary stencil printer incorporating an embodiment of the present invention.

DESCRIPTION OF THE PREFERRED EMBODIMENTS

In the following, the present invention will be described in more detail with respect to some embodiments thereof with reference to the accompanying drawing.

Figure 1:
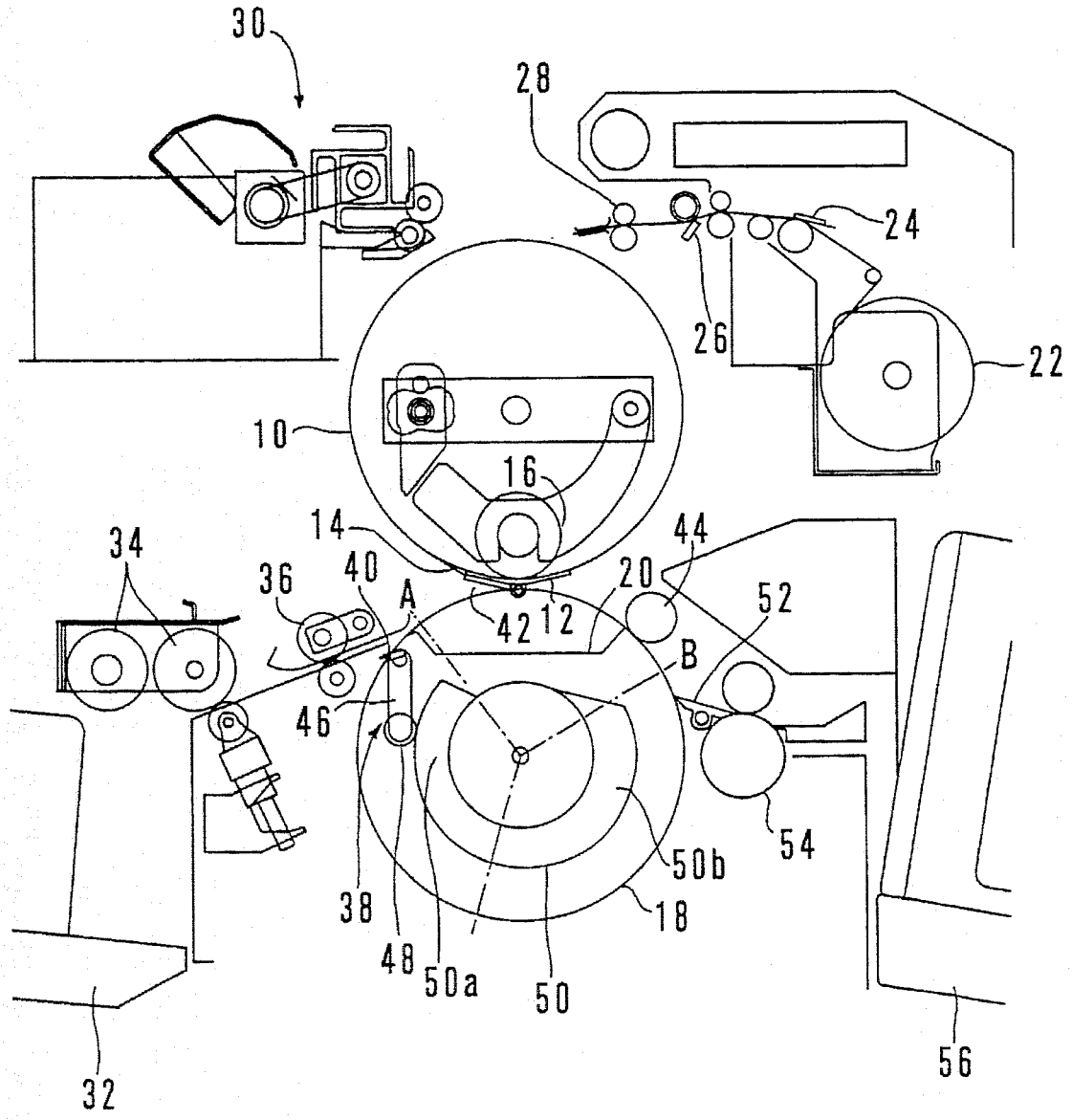

Referring to FIG. 1 diagrammatically showing the construction of an example of rotary stencil printer incorporating an embodiment of the print sheet leading end mounting device according to the present invention, 10 is a cylindrical printing drum having a stencil sheet leading end mounting means 12 and adapted to carry a stencil sheet 14 therearound with a leading end thereof being mounted to the stencil sheet leading end mounting means, the stencil sheet being wrapped around the printing drum as adhered thereto by the adhesiveness of the ink. The printing drum herein shown has a construction that the principal portion of the circumference thereof is constructed by a perforated sheet material such as a net material, and a portion of the perforated circumference is selectively bulged out beyond the cylindrical contour thereof by an inking roller 16. Opposing the position at which a portion of the perforated circumference of the printing drum is bulged out by the inking roller 16 there is disposed a back press means which is constructed as a back press roller 18 in the shown embodiment. The back press roller 18 has the same diameter as the printing drum 10, and is adapted to rotates in a direction opposite to that of the printing drum in synchronization therewith. The back press roller 18 is formed with a groove 20 at a circumferential portion thereof which aligns with the stencil sheet leading end mounting means 12 of the printing drum when they meet one another.

The stencil sheet 14 wrapped around the printing drum 10 is drawn out from a stencil sheet roll 22 serving as a source of supply thereof, then it is formed with perforations at a perforation head 24 controlled by an electronic image processing means, then it is cut by a cutter 26, and then it is fed by a pair of feed rollers 28. A used stencil sheet is removed from the printing drum by an used stencil removal means generally designated by 30.

Print sheets are supplied from a source thereof piled up on a print sheet supply tray 32, by print sheet feed rollers 34 and a timing roller 36, so that each print sheet is attached at its leading end to a portion of the outer circumference of the back press roller 18 by a claw-like clamp member 40 of a print sheet leading end mounting device 38, and is transferred through a nip region 42 formed between opposing portions of the printing drum 10 and the back press roller 18, at which the printing drum is bulged out by the inking roller 16, according as the back press roller 18 rotates in synchronization with the printing drum 10. In FIG. 1 the printer is shown in a state that a print sheet not shown in the figure fed by the timing roller 36 has proceeded so far that its leading end is slightly before being engaged by the clamp member 40, so that, when the back press roller rotates clockwise a little further in synchronization with a corresponding anti-clockwise rotation of the printing drum 10, for the clamp member 40 to come to an angular position such as A in the figure, the leading end of the print sheet is inserted into below the clamp member 40 prepared in a half open state.

The print sheet transferred through the nip region 42 and applied therein with a printing image in the condition supported on the back press roller 18, with its leading end attached thereto by the clamp member 40, moves out of the nip region as still carried on the back press roller 18, and then it is pressed to the back press roller 18 at its opposite edge portions by a pair of pinch rollers 44. When the leading end of the print sheet reaches an angular position such as B in the figure, the clamp member 40 opens widely to release the clamping of the leading end of the print sheet. Such an action of the clamp member 40 that it closes at the angular position A to clamp the leading end of the print sheet and opens at the angular position B to release the leading end of the print sheet is obtained by the clamp member 40 being mounted to be pivotable about an axis disposed adjacent the outer circumference of the back press roller 18 and turned by an arm member 46 which is swung about the pivot axis by a roller 48 mounted at a free end thereof being guided to follow a cam 50 disposed around the central axis of the back press roller 18. In more detail, when the back press roller 18 rotates further from the position shown in the figure so far that the clamp member 40 reaches the angular position A, the roller 48 falls into a valley portion of the cam 50, so that the arm member 46 turns about the pivot axis anti-clockwise in the figure, thereby turning the clamp member 40 to its closed position where it clamps the leading end of a print sheet which is just inserted into below the closing clamp member by a synchronized operation of the timing roller 36. When the back press roller 18 rotates further so far that the clamp member 40 comes to the angular position B, the roller 48 climbs up to a hill portion of the cam 50, so that the clamp member 40 is turned about the pivot axis clockwise to widely open and release the clamped leading en of the print sheet, allowing the print sheet to leave away from the back press roller 18, starting from the leading end thereof.

When the back press roller 18 rotates further, the leading end of the print sheet released from the clamping by the clamp member 40 is scooped up by a print sheet removal claw 52, so that the print sheet is thereafter removed off from the back press roller to be forwarded by a print sheet disposal rollers 54 toward a print sheet disposal tray 56. As will be appreciated from the figure, the height of the hill portion of the cam 50 is varied such that a hill portion **50*a* is lower than a hill portion 50*b*, or the hill portion 50*b* is higher than the hill portion 50*a*, whereby the clamp member 40 is opened at the angular position A at such a relatively small angle that ensures the insertion of the leading end of a print sheet into below the clamp member, while at the angular position B the clamp member 40** is opened widely enough to release the leading end of the print sheet for the disposal thereof.

Figure 2:
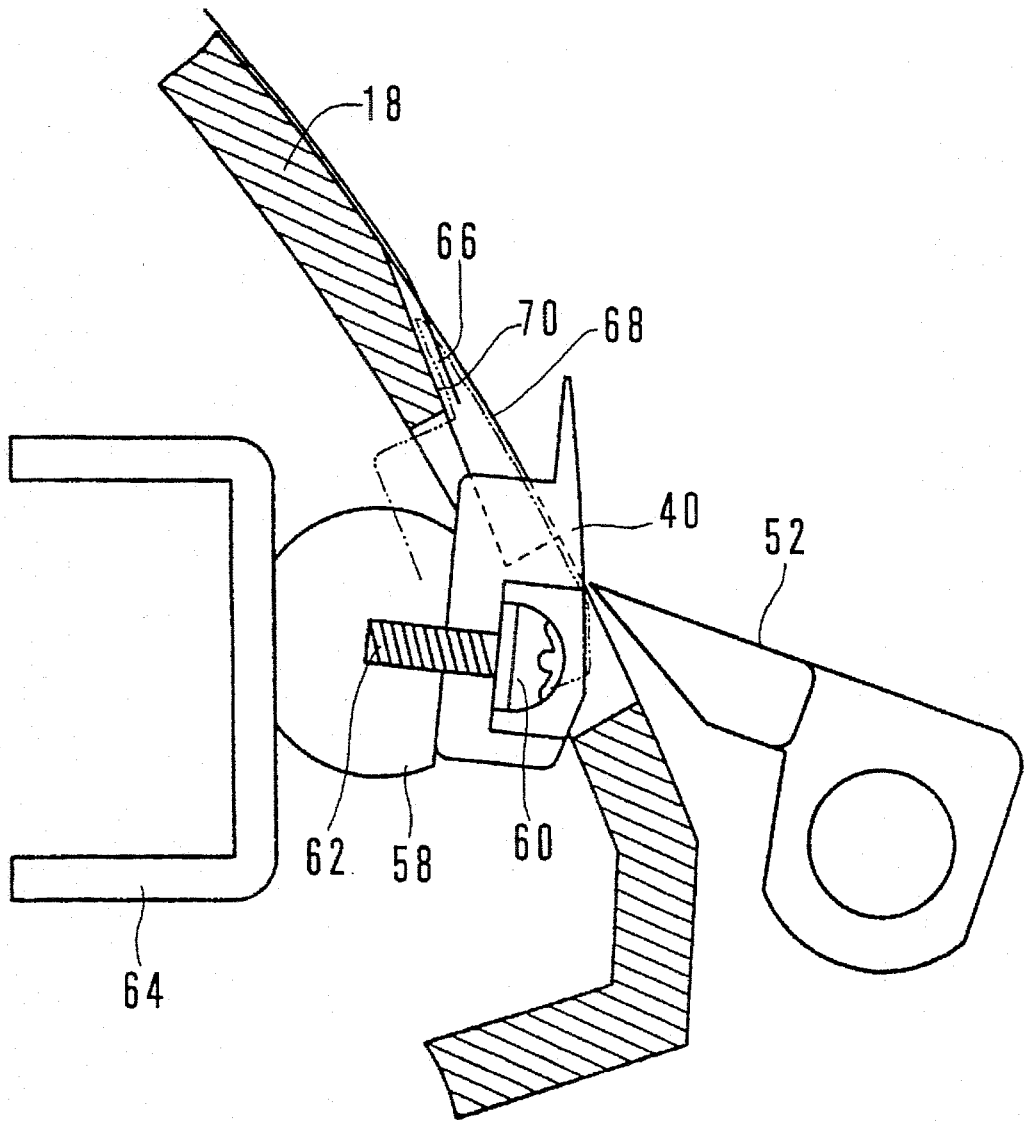
FIG. 2 PRIOR ART
FIG. 2 is a magnified partial view corresponding to a part of the rotary stencil printer shown in FIG. 1, illustrating the problem which would occur when the print sheet leading end lifting means according to the present invention is not incorporated.

FIG. 2 is a view showing the clamp member 40 and portions therearound as somewhat enlarged in a condition that the clamp member 40 opened at the angular position B has come to traverse the print sheet removal claw 52, particularly showing what will happen if the print sheet leading end lifting means according to the present invention is not incorporated. In FIG. 2, the portions corresponding to those shown in FIG. 1 are designated by the same reference numerals. In further details, the clamp member 40 is mounted on a bar member 58 by a screw 60 so as to pivot about a pivot axis 62 coinciding with a central axis of the bar member 58. A channel member 64 is a practical member provided for increasing the rigidity of the bar member 58. As will be apparent from FIG. 2, when the clamp member 40 is turned about the pivot axis 62 to its closed position for clamping a leading end 66 of a print sheet to the back press roller 18, the clamp member 40 is housed within the outer contour 68 of the back press roller 18, and therefore, the back press roller 18 is formed with a surface obliquely sunk below the outer contour 68 at a portion such as indicated by 70 on which the leading end of a print sheet clamped by the clamp member 40 is placed. Therefore, when the leading end 66 of the print sheet is clamped by the clamp member 40 along the inclined print sheet leading end supporting surface 70, the leading end 66 becomes bent as shown in the figure relative to the following principal portion of the print sheet. When once the leading end 66 of the print sheet has thus been bent inward, even when the clamping by the clamp member 40 is released, the leading end does not immediately return to its original straight form, and therefore, as the back press roller 18 rotates further, it can happen that the leading end 66 of the print sheet is not engaged by the tip of the print sheet leading end removal claw 52, disordering the regular transfer of the print sheet to the print sheet disposal tray 56.

Figure 3:
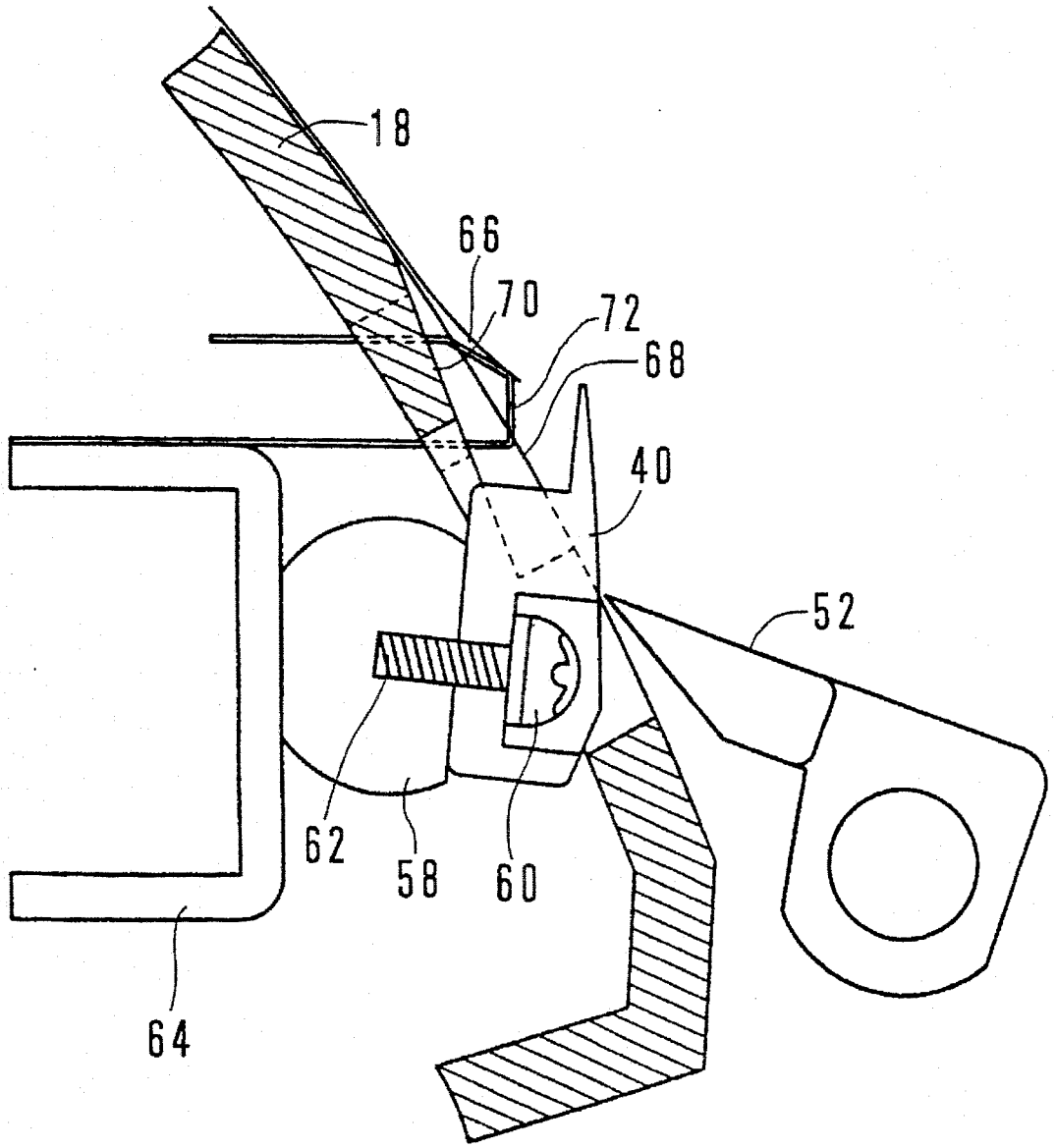
FIG. 3 is a magnified partial view showing an embodiment of the print sheet leading end mounting device according to the present invention.

FIG. 3 is an enlarged partial view similar to FIG. 2, showing a condition that the print sheet leading end lifting means according to the present invention is incorporated therein. In this figure, 72 indicates an embodiment of the print sheet leading end lifting means, which is made of an elastic plate member shaped as shown in the figure and mounted to the reinforcing channel member 64, so as to be turned around the axis 62, according to the pivotal movement of the bar member 58 between the clamp position where the clamp member 40 clamps the leading end 66 of a print sheet to an inclined supporting surface 70 and the release position where the clamp member releases the clamping, such that, when the clamp member 40 is opened as shown in the figure, the member 72 pushes up the leading end 66 of the print sheet from the inclined leading end support surface 70 to be floated above the cylindrical outer contour 68 of the back press roller, while when the clamp member 40 is turned to the position for clamping the leading end 66 of the print sheet, the member 72 retreats below the leading end support surface 70. As a matter of course, the angular relationship between the clamp member 40 and the print sheet leading end lifting member 72 is so determined that, when the clamp member 40 is in the half open condition at the angular position A in FIG. 1 to receive the leading end of a print sheet, the member 72 is at a position not to interfere with the reception of the leading end of the print sheet by the clamp member.

Although the member 72 is mounted to the channel member 64 so as to be turned around the pivot axis 62 by the bar member 58 together with the clamp member 40 in the construction shown in FIG. 3, such a modification is possible that the member 72 is supported by an appropriate support means to be flexibly biased relative to the support surface 70 based upon its own elasticity or the elasticity of the support means, so as to be biased below the support surface 70 when the clamp member 40 is turned to the clamp position, while the member 72 elastically projects out of the support surface 70 when the clamp member 40 is turned to the open position.

Figure 4:
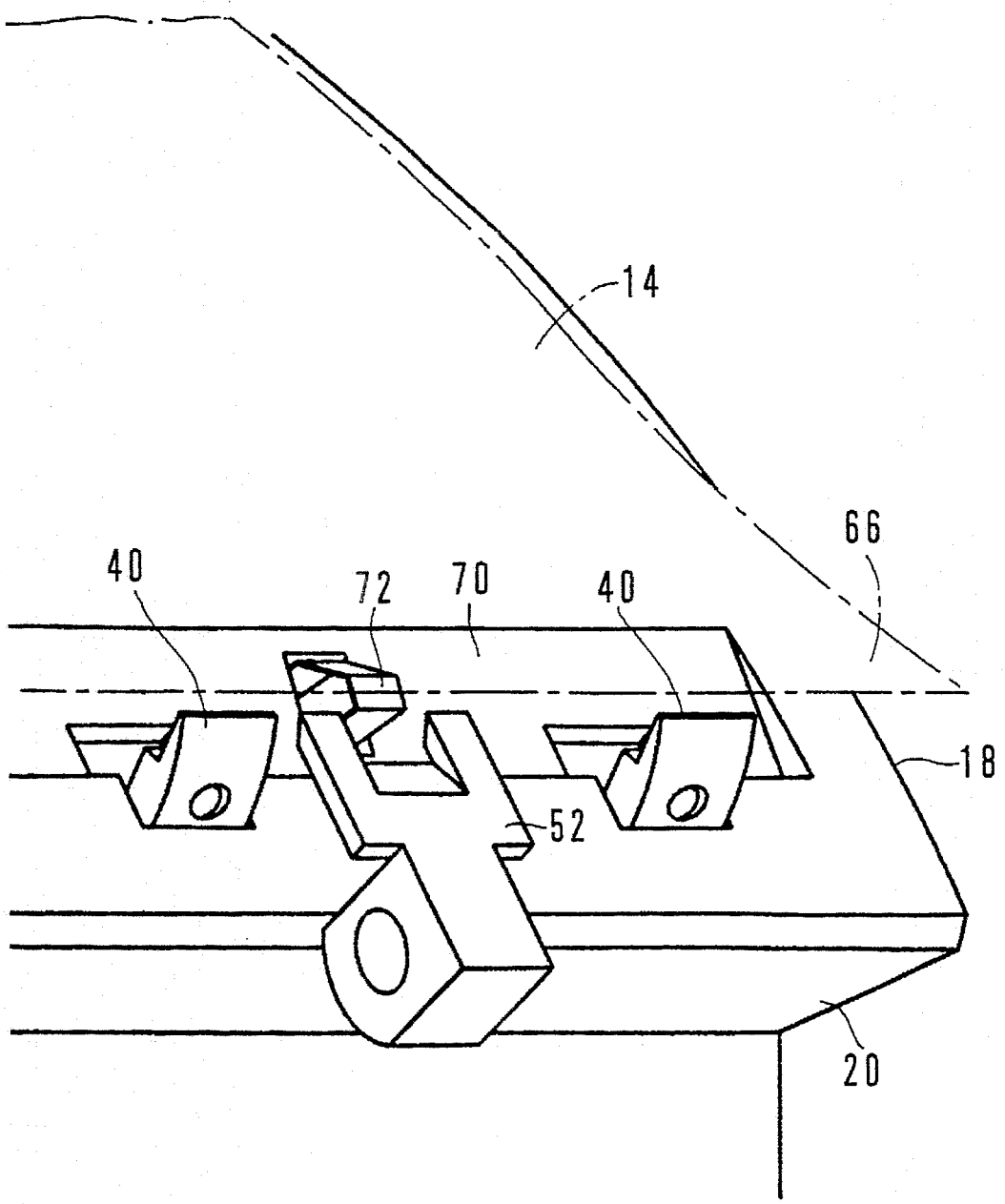
FIG. 4 is a perspective view of the print sheet leading end mounting device shown in FIG. 3.

FIG. 4 is a perspective view showing the construction shown in FIG. 3. In FIG. 4, the portions corresponding to those shown in FIG. 3 are designated by the same reference numerals as in FIG. 3. As will be appreciated from FIG. 4, the clamp member 40 is constructed as a plurality of members having a relatively small width and spaced along the axis of the back press roller 18 or widthwise thereof, and similarly, the member 72 providing the print sheet leading end lifting means is also constructed as separated into a plurality of members (though only one is shown) having a relatively small width. Further, the print sheet removal claw 52 is also constructed as a plurality of members (though only one is shown) distributed over the width of the back press roller 18 and arranged not to interfere with the clamp members 40 and the members 72 of the print sheet leading end lifting means. Further, the groove 20 is shown in FIG. 4, and it will be noted that the print sheet leading end mounting device constructed by the clamp members 40 and others is substantially shifted apart from the edge of the groove along the circumference of the back press roller such that a substantial circumferential band area is left along the edge of the groove.

Figure 5:
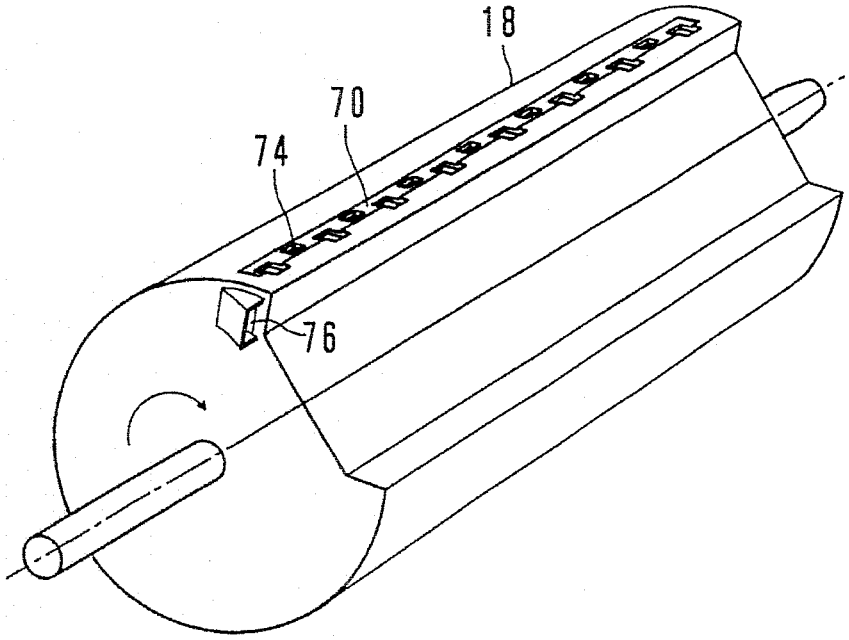
FIG. 5 is a diagrammatic perspective view showing a back press roller incorporating an embodiment of the print sheet leading end mounting device according to the present invention.

FIG. 5 is a somewhat diagrammatic perspective view of the back press roller incorporating another embodiment of the print sheet leading end lifting means according to the present invention. In this embodiment, the action of lifting the leading end 66 of the print sheet from the supporting surface 70 as provided by the member 72 in the embodiment of FIG. 3 is provided by a means comprising air ejection ports 74 opening along the print sheet leading end supporting surface 70 and air intake ports 76 opening at the opposite side walls of the back press roller 18 toward its rotational direction and communicating with the air ejection ports through internal passages. In this construction, when the back press roller 18 rotates in the direction shown by an arrow during the printing operation, the air intake ports 76 take in air by the dynamic pressure generated by the relative flow of air, and distribute it to the air ejection ports 74 through the internal passages so as to be ejected out therefrom. Since the leading end 66 of the print sheet released from the clamping by the clamp member 40 is ready to float up from the supporting surface 70 by a very weak air pressure, the leading end of the print sheet can be floated up enough to be engaged by the removal claw 52, even with such a simple ventilation means.

Figure 6:
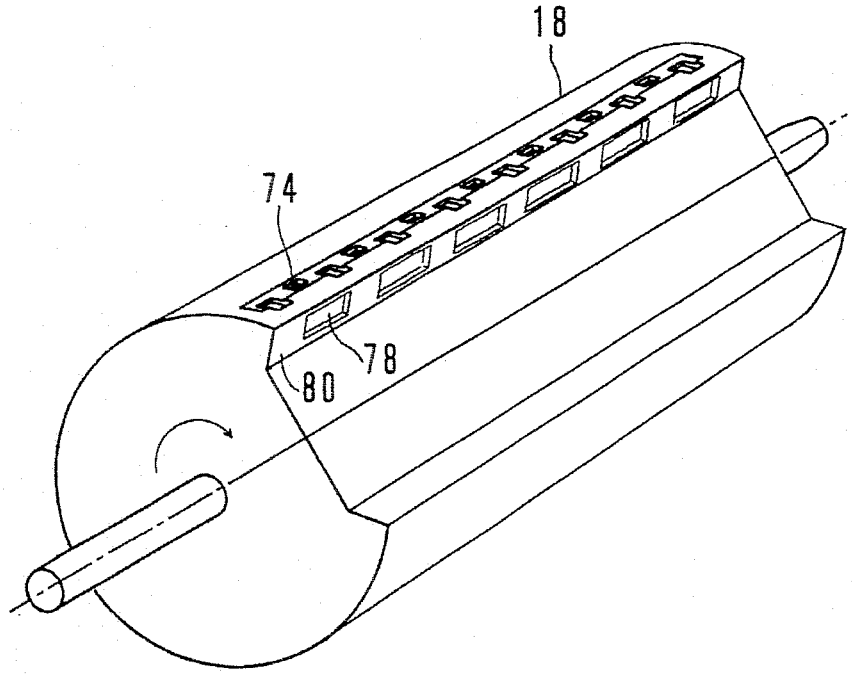
FIG. 6 is a diagrammatic perspective view showing a back press roller incorporating still another embodiment of the print sheet leading end mounting device according to the present invention.

FIG. 6 is a view similar to FIG. 5, showing another embodiment of the print sheet leading end lifting means constructed as a ventilation means. In this embodiment, air intake ports 78 for supplying air for the same plurality of air ejection ports 74 as in the embodiment of FIG. 5 are provided to open at a side wall 80 of the groove 20 oriented to face the upstream of the relative air flow generated by the rotation of the back press roller 18. It will be apparent that the object of the present invention is also accomplished by the ventilation means of this construction.

Although the present invention has been described in detail with respect to some embodiments thereof, it will be apparent for those skilled in the art that various modifications with respect to the shown embodiments or other embodiments are possible based upon the technical concept of the present invention.

We claim:

1. A device for mounting a leading end of a print sheet of a rotary stencil printer having a printing drum for carrying a stencil sheet therearound and a back press means having a surface opposing said printing drum for supporting the print sheet such that the print sheet is transferred through between said printing drum and said back press means with the leading end thereof being mounted to said back press means by said print sheet leading end mounting device so as to be applied with a stencil printing thereon, comprising a combination of a claw-like clamp member for selectively clamping the leading end of the print sheet to said back press means and a print sheet leading end lifting means for pushing the leading end of the print sheet to be floated up from the print sheet supporting surface of said back press means.

2. A print sheet leading end mounting device of claim 1, wherein said clamp member is a pivoting member adapted to selectively pivot about a pivot axis disposed adjacent the print sheet supporting surface of said back press means to selectively clamp the leading end of a print sheet, and said print sheet leading end lifting means is integrally connected with said clamp member so as to pivot about said pivot axis together with said clamp member such that, when said clamp member turns to clamp the leading end of the print sheet from an upper surface thereof to said back press means, said print sheet leading end lifting means moves to depart from a lower surface of the leading end of the print sheet, while, when said clamp member turns to release the leading end of the print sheet, said print sheet leading end lifting means turns to push up the leading end of the print sheet from the lower surface thereof.

3. A print sheet leading end mounting device of claim 1, wherein said print sheet leading end lifting means is a ventilation means for blowing air to the print sheet leading end from the lower surface thereof.

4. A print sheet leading end mounting device of claim 3, wherein said ventilation means is adapted to ventilate by a flow of air generated relative to said back press means when said back press means moves to transfer the print sheet during the stencil printing.

5. A print sheet leading end mounting device of claim 1, wherein said printing drum has a stencil sheet leading end mounting means, and said back press means is a roller adapted to rotate in synchronization with rotation of said printing drum and having a groove for receiving said stencil sheet leading end mounting means of said printing drum at a portion thereof which aligns with said stencil sheet leading end mounting means during the rotation thereof, said print sheet leading end mounting device being positioned to leave a substantial circumferential band area along an adjacent edge of said groove.

* * * * *